US010463903B2

(12) United States Patent
Johnson

(10) Patent No.: US 10,463,903 B2
(45) Date of Patent: Nov. 5, 2019

(54) PHYSICAL THERAPY MOBILIZATION BELT AND METHOD OF USE

(71) Applicant: Johnson Athletic Advantage LLC, Allen, TX (US)

(72) Inventor: Cody Johnson, Allen, TX (US)

(73) Assignee: Johnson Athletic Advantage LLC, Allen, TX (US)

( * ) Notice: Subject to any disclaimer, the term of this patent is extended or adjusted under 35 U.S.C. 154(b) by 44 days.

(21) Appl. No.: 15/356,218

(22) Filed: Nov. 18, 2016

(65) Prior Publication Data

US 2018/0140884 A1 May 24, 2018

(51) Int. Cl.
*A63B 21/002* (2006.01)
*A63B 21/04* (2006.01)
(Continued)

(52) U.S. Cl.
CPC ..... *A63B 21/0023* (2013.01); *A63B 21/04* (2013.01); *A63B 21/068* (2013.01);
(Continued)

(58) Field of Classification Search
CPC ..... A63B 21/1663; A63B 21/0442; A63B 21/0407; A63B 21/04; A63B 21/1645; A63B 21/1636; A63B 21/1654; A63B 21/0023; A63B 21/4034; A63B 21/4023; A63B 21/4019; A63B 21/4011; A63B 21/4035; A63B 21/4043; A63B 21/4015; A63B 21/068; A63B 21/151; A63B 21/4013; A63B 2210/50; A63B 2225/09; A63B 23/03508; A63B 23/0355; A63B 2023/006; A63B 2069/0062; A63B 21/16; A63B 21/018; A63B 21/1681
See application file for complete search history.

(56) References Cited

U.S. PATENT DOCUMENTS 843,478 A * 2/1907 Muller ..... A63B 21/0552 482/124
4,325,548 A 4/1982 Piccini
(Continued)

FOREIGN PATENT DOCUMENTS

WO 2013003280 1/2013

OTHER PUBLICATIONS

"Pro Ankle Cinch Strap," Perform Better, performbetter.com, Apr. 20, 2016.
(Continued)

*Primary Examiner* — Andrew C Lo
(74) *Attorney, Agent, or Firm* — Schultz & Associates, P.C.

(57) ABSTRACT

Disclosed is portable and easily securable mobilization belt for performing physical therapy on an affected joint comprising a continuous loop of inelastic woven material. The loop comprises an expanded section for securing in a door jamb and a cushioned section for contact with the patient's affected joint. Alternatively, the loop can be secured by wrapping around a vertical stanchion of a heavy piece of furniture or other solid object that will not move. In use, the affected joint is placed in the loop adjacent the cushioned section. With the loop taut, the patient provides resistance against the belt to create mobilization of the affected joint.

1 Claim, 8 Drawing Sheets

(51) Int. Cl.
*A63B 21/068* (2006.01)
*A63B 21/00* (2006.01)
*A63B 21/16* (2006.01)

(52) U.S. Cl.
CPC ..... *A63B 21/151* (2013.01); *A63B 21/1663* (2013.01); *A63B 21/4011* (2015.10); *A63B 21/4013* (2015.10); *A63B 21/4015* (2015.10); *A63B 21/4019* (2015.10); *A63B 21/4023* (2015.10); *A63B 21/4034* (2015.10); *A63B 21/4035* (2015.10); *A63B 21/4043* (2015.10); *A63B 2210/50* (2013.01); *A63B 2225/09* (2013.01)

(56) References Cited

U.S. PATENT DOCUMENTS 4,998,722 A 3/1991 Scott
5,100,129 A 3/1992 Porter
5,186,698 A 2/1993 Mason
5,254,065 A 10/1993 Pollock
5,582,579 A 12/1996 Chism
5,653,668 A 8/1997 Wilkinson
5,766,118 A * 6/1998 Conner ..... A63B 21/0552 482/121
5,836,857 A 11/1998 Jennings
6,059,698 A 5/2000 Mazor
6,149,559 A 11/2000 Mackey
6,322,483 B1 11/2001 Rotella
6,497,641 B1 12/2002 Hinds
6,540,651 B1 4/2003 Aberton
6,908,418 B2 6/2005 Saure
6,921,354 B1 * 7/2005 Shifferaw ..... A63B 21/068 482/126
7,438,674 B2 10/2008 Sjodin
8,038,584 B1 * 10/2011 Pruessner ..... A61H 1/02 482/143
8,083,653 B2 12/2011 Hetrick
D664,612 S 7/2012 Pinskiy
8,696,527 B2 4/2014 Wu
9,022,905 B2 5/2015 Lutz
9,114,270 B2 8/2015 Aldridge
2002/0022555 A1 2/2002 Nesci
2012/0190510 A1 7/2012 Wang
2013/0178345 A1 * 7/2013 Wu ..... A63B 21/068 482/139
2014/0080687 A1 * 3/2014 Stuef ..... A63B 21/04 482/129
2014/0274569 A1 * 9/2014 Lewen ..... A63B 7/02 482/24
2015/0141217 A1 * 5/2015 Young ..... A63B 21/0442 482/126
2015/0182776 A1 * 7/2015 Lewen ..... A63B 7/02 482/24
2015/0283420 A1 * 10/2015 Chang ..... A63B 21/0555 482/129
2016/0236026 A1 * 8/2016 Hauptmann ..... A63B 21/0442
2016/0287927 A1 * 10/2016 Hunter ..... A63B 21/4035

OTHER PUBLICATIONS

"Ankle Wrist Straps," Stroops, stroops.com, Jun. 28, 2015.
"All Legs Ankle Strap," Stoops, stroops.com, Feb. 5, 2015.
"How Webbing is Made: An Overview of Webbing," Materials Handling, https://www.thomasnet.com/articles/materials-handling/what-is-webbing, (last visited Nov. 19, 2018).

* cited by examiner

PHYSICAL THERAPY MOBILIZATION BELT AND METHOD OF USE

FIELD OF THE DISCLOSURE

The present disclosure relates generally to exercise equipment. In particular, the present disclosure relates to a portable, easily securable physical therapy belt capable of providing joint mobilization intervention.

BACKGROUND OF THE DISCLOSURE

Restricted joint movement due to injury, accident, illness, etc., can consequently have deleterious effects not only at the involved joint but throughout the rest of the body as well. For example, as a result of a common ankle sprain, inflammation and tissue damage may occur at the ankle which can restrict range of motion and result in deficits in strength and proprioception (awareness of a joint's relative location). If not corrected, this limited range of motion will disrupt normal ankle motion and create compensation patterns at the hip, knee, and spine. These compensatory patterns, over time, will likely cause damage to these areas of the body.

A consistent program of physical therapy performed on the affected joint, primarily comprised of stretching and resistance movements, is essential in strengthening the joint and ensuring range of motion is not compromised. A physical therapist is trained in providing exercises and joint mobilization movements aided by unique tools or equipment designed to assist in the recovery of a patient. Physical therapy could last for up to six to eight weeks post injury and most importantly should be consistently performed at least 5 days a week for a set time each day. However, often it is difficult for a patient to visit a physical therapist with such regularity. Work schedules, travel schedules, or proximity to the therapist's office can all inhibit the suggested physical therapy schedule. There is a need for a joint mobilization device that is easily transportable and effective such that a patient can continue the physical therapy wherever they happen to be when a visit to the physical therapist's office is unavailable or inconvenient.

The prior art discloses various portable exercise devices intended to provide resistance movements but none directed specifically at joint mobilization rehabilitation. Disadvantages of the prior art include a multitude of required parts, complicated construction, and high manufacturing cost.

For example, U.S. Patent Publication No. 2012/0190510 to Wang discloses a suspension exercising device which can be anchored to a door. The device comprises an elongated strip that is folded back on itself and secured with at least two buckles to create loops on each end. The length of the strip is adjustable via the buckles. One of the loops secures a handle and the opposite loop becomes an anchoring device for wedging in a door jamb when wrapped around a support member.

U.S. Pat. No. 8,083,653 to Hetrick discloses an exercise apparatus having a door anchor fixed to a pair of elongated members. The elongated members include various other buckles, loops, and handles for attachment of numerous exercise equipment and handholds. The door anchor includes an enlarged portion that when positioned on the opposite side of the door from the elongated members, supports the weight of a user.

U.S. Pat. No. 5,836,857 to Jennings discloses an apparatus for applying lateral force to body joints. The apparatus comprises a generally inelastic connecting medium having a first end and a second end. The first end is connected to a padded cuff sized to receive a portion of a foot or leg to which the lateral force is applied. The second end is connected to a hook mounted to a stationary object.

Hence, there is a need for a portable, uncomplicated, and easily anchorable device for providing resistance movements specifically designed for joint mobilization.

SUMMARY OF THE DISCLOSURE

A preferred embodiment comprises a continuous loop of inelastic woven material. The loop contains an expanded section for securing in a door jamb. Opposite the expanded section is a cushioned section for contact with the patient. Alternatively, the loop can be secured by attaching it to a vertical post, for example, to the leg of a heavy piece of furniture or other solid object. The device is easily transportable and can be used in different locations.

In use, the loop is anchored. The involved joint is secured inside the loop adjacent the cushioned section. Any slack in the loop is removed. With a steady stance, the patient leans into the cushioned section creating resistance at the affected joint.

Those skilled in the art will appreciate the above-mentioned features and advantages of the disclosure together with other important aspects upon reading the detailed description that follows in conjunction with the drawings.

DETAILED DESCRIPTION

In the description that follows, like parts are marked throughout the specification and figures with the same numerals, respectively. The figures are not necessarily drawn to scale and may be shown in exaggerated or generalized form in the interest of clarity and conciseness.

Figure 1:
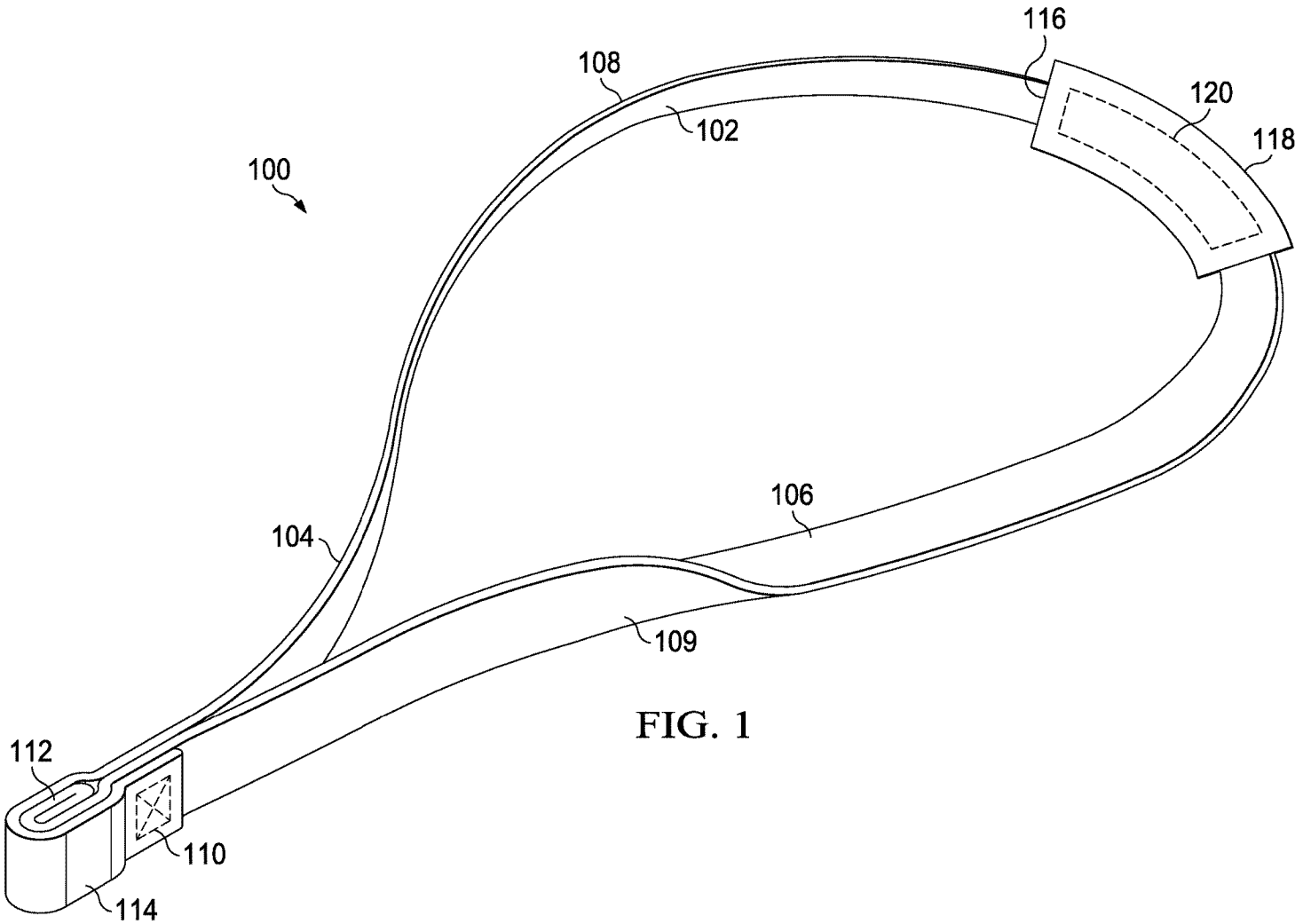
FIG. 1 is an isometric view of a preferred embodiment.

Referring to FIG. 1, mobilization belt 100 comprises band 102 formed in a loop having exterior surface 104 and interior surface 106. Band 102 is comprised of a single length of woven material having ends 110 and 112. Ends 110 and 112 are affixed together at expanded section 114 to form the loop. Expanded section 114 is diametrically opposed to cushioned section 116. Side 108 extends between expanded section 114 and cushioned section 116. Side 109 completes the loop and also extends between expanded section 114 and cushioned section 116. Cushioned section 116 comprises pad 118 attached to interior surface 106 with stitching 120. In alternate embodiments, pad 118 is replaceable and can be removably attached to band 102 with hook and loop fastener, adhesive, buttons, snaps, etc. In a preferred embodiment, mobilization belt 100 is constructed of a woven polymeric material such as polyester or nylon having a tensile strength sufficient to support up to approximately 500 lbs. The material should be flexible, capable of folding upon itself, and generally inelastic.

The overall length of band 102 from end 110 to end 112 can range from four to eight feet. Expanded section 114 is formed from generally twelve to eighteen inches of the overall length of band 102. The distance between expanded section 114 and cushioned section 116 along band 102 ranges from 18 inches to three ½ feet. Band 102 ranges in width from approximately two to four inches. Band 102 ranges in thickness from approximately ⅛ to ¼ inch. The dimensions of pad 118 generally range from two to four inches wide and four to eight inches long. Pad 118 ranges in thickness from approximately ¼ to one inch and is formed of common cushioning materials such as foam, felt, or soft rubber.

Figure 2A:
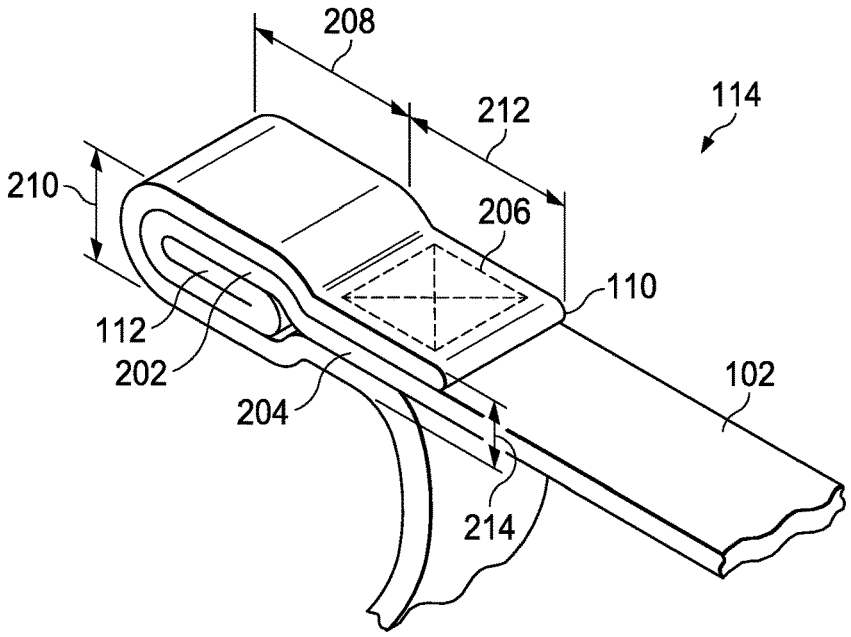
FIG. 2A is a partial isometric view of an expanded section of a preferred embodiment.

Referring to FIG. 2A, expanded section 114 comprises rolled segment 202 adjacent connecting segment 204. In a preferred embodiment, rolled segment 202 is formed by folding end 112 over upon itself at least two times to form a flattened cylindrical roll. In alternate embodiments, end 112 may be folded over more than two times. Rolled segment 202 further comprises end 110 wrapped around the flattened cylindrical roll formed by end 112. Rolled segment 202 has length 208. Length 208 ranges from approximately one to two inches. Rolled segment 202 has thickness 210. Thickness 210 ranges from approximately ⅝ to one ½ inches. Thickness 210 is generally 5 times greater than the thickness of band 102. Thickness 210 should be sufficient to prevent rolled segment 202 from passing through the space between where an edge of a door meets a door frame when the door is in a closed position. Connecting segment 204 is a generally flat section adjacent rolled segment 202. Connecting segment 204 has length 212. Length 212 ranges from approximately one to two inches. Connecting segment 204 has thickness 214. Thickness 214 ranges from approximately ⅜ to ¾ inch. Due to compressive forces acting on connecting segment 204 during use, thickness 214 may vary but is generally 3 times greater than the thickness of band 102. Ultimately, connecting segment 204 must have a thickness that is capable of passing through the space between where an edge of a door meets a door frame when the door is in a closed position without affecting the operation of the door. Connecting segment 204 includes stitching 206. Stitching 206 affixes end 110 to end 112. Stitching 206 passes through at least three thicknesses of band 102 at connecting segment 204. The connection of ends 110 and 112 in connecting segment 204 maintains rolled segment 202. In a preferred embodiment, stitching 206 is constructed of flexible polymeric fibers such as bonded nylon thread having a tensile strength in the range of 10 to 30 lbs. In an alternate embodiment, adhesives may be used to affix end 110 to end 112.

Figure 2B:
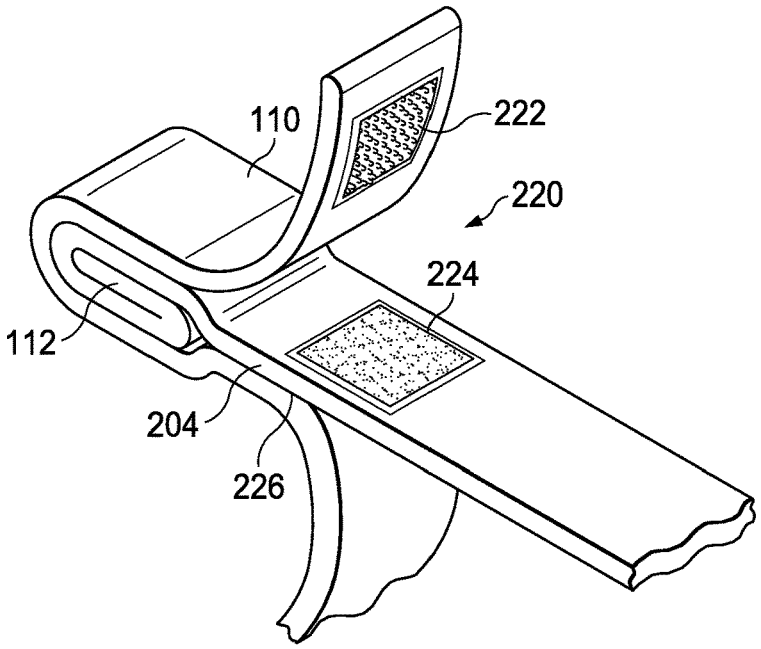
FIG. 2B is a partial isometric view of an expanded section of an alternate embodiment.

In an alternate embodiment shown in FIG. 2B, connecting segment 204 is removable and includes hook and loop fastener 220. Hook and loop faster 220 is a Velcro® type fastener having hook segment 222 attached to interior surface 106 proximate end 110 and loop segment 224 attached exterior surface 104 proximate end 112. Alternatively, the placement of the hook segments and loop segments could be swapped. Additionally another hook and loop fastener pair affix end 110 to the opposite side of end 112 at connection point 226.

Figure 2C:
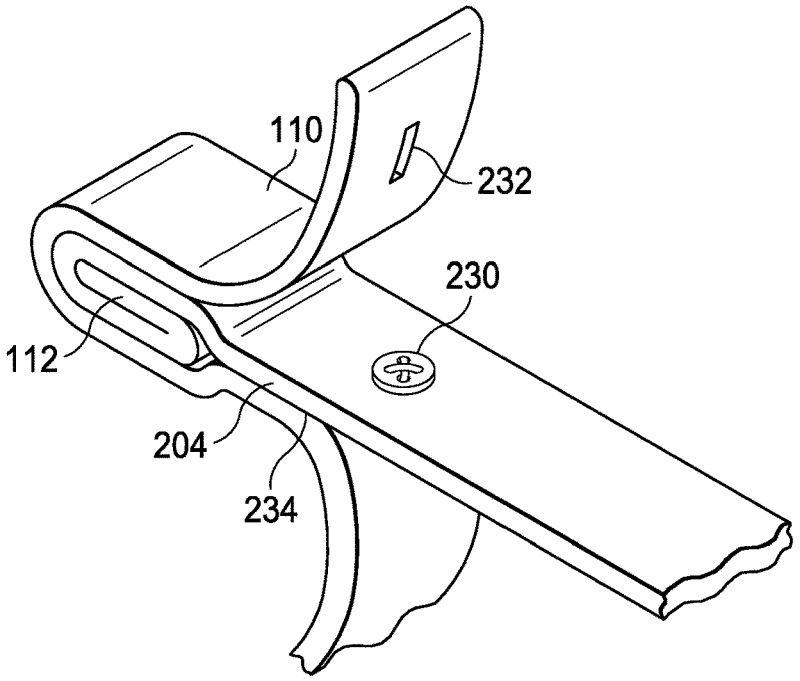
FIG. 2C is a partial isometric view of an expanded section of an alternate embodiment.

In an alternate embodiment shown in FIG. 2C, connecting segment 204 is removable and includes button 230 attached to exterior surface 104 of end 112 and button hole 232 formed in end 110. End 110 is affixed to end 112 via button 230 engaging button hole 232. Additionally another button and button hole setup connects end 110 to the opposite side of end 112 at connection point 234.

Figure 2D:
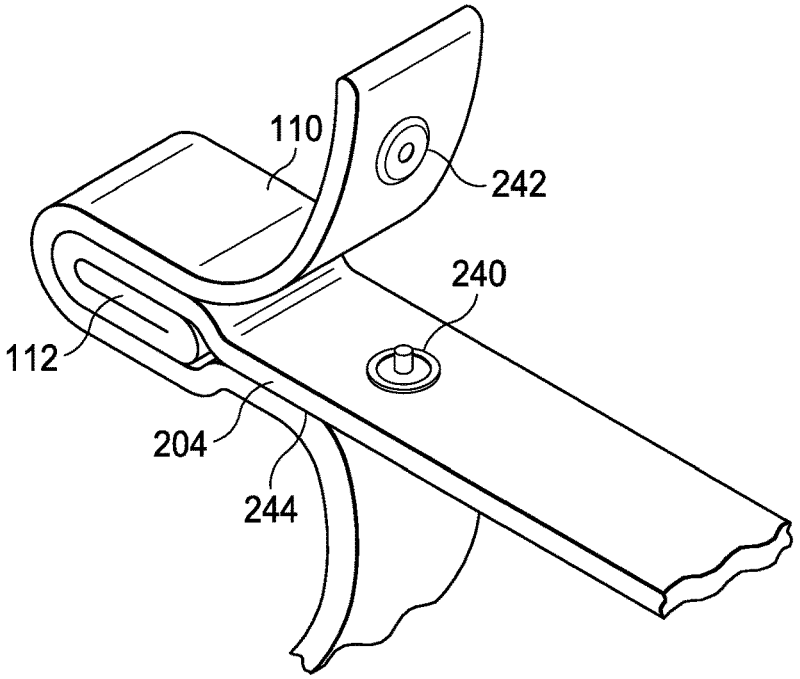
FIG. 2D is a partial isometric view of an expanded section of an alternate embodiment.

In an alternate embodiment shown in FIG. 2D, connecting segment 204 is removable and includes snap 240 attached to exterior surface 104 of end 112 and snap receiver 242 attached to interior surface 106 of end 110. End 110 is connected to end 112 with snap 240 engaging snap receiver 242. Additionally another snap and snap receiver setup connects end 110 to the opposite side of end 112 at connection point 244.

Figure 3A:
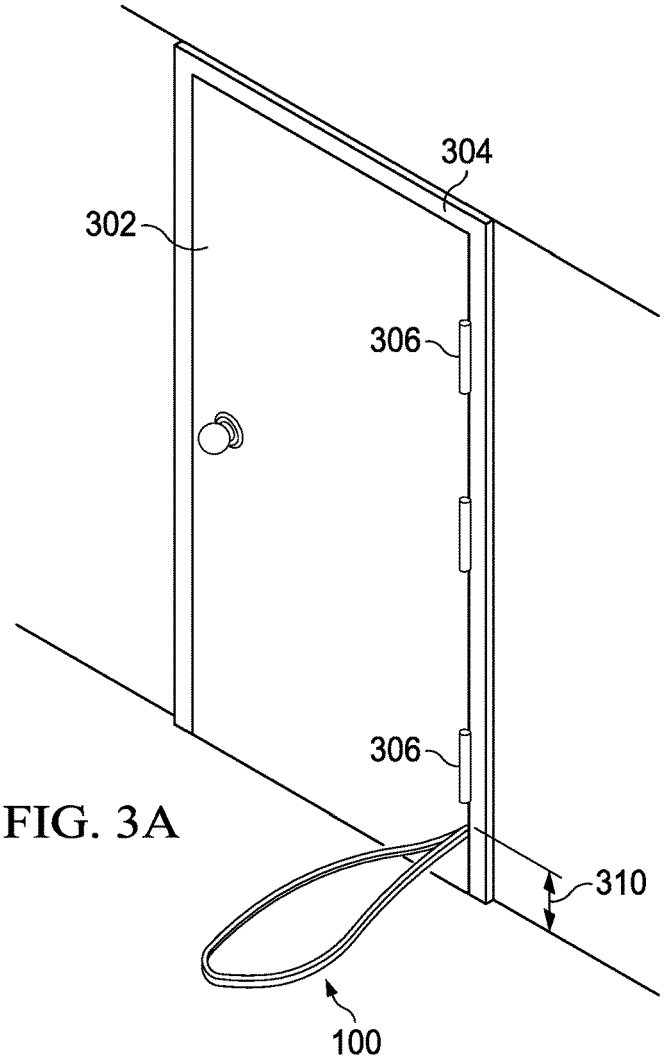
FIG. 3A is an isometric view of a preferred embodiment engaged with a door frame.
Figure 3B:
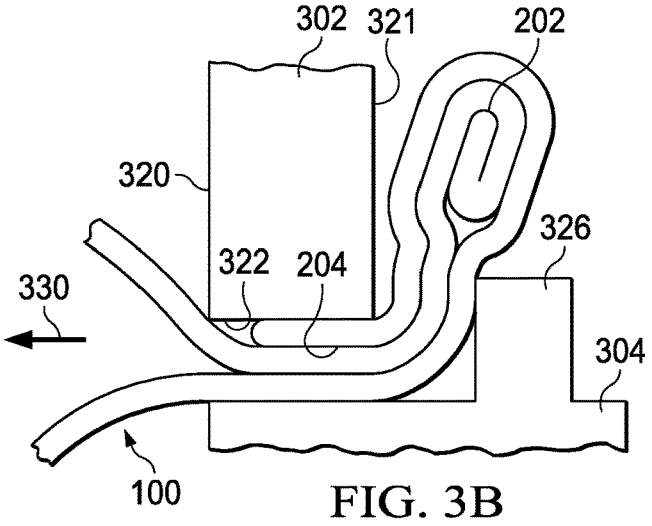
FIG. 3B is a cut away view of a preferred embodiment engaged with a door frame.

As shown in FIGS. 3A and 3B, in order to provide the necessary resistance to perform physical therapy on an affected joint, mobilization belt 100 is secured between the edge of a closed door and a door frame. Door 302 is pivotally mounted to door frame 304 with hinges 306. Mobilization belt 100 is lodged between door 302 and door frame 304 at height 310. Height 310 varies depending on the size of the patient and the location of the affected joint. Band 102 is generally parallel with the floor when secured to the door and engaged with a patient.

Door 302 includes face 320 opposite rear 321. Disposed between face 320 and rear 321 is door edge 322. Door frame 304 typically includes door stop 326. A door typically operates such that when door 302 is in a closed position, rear 321 abuts door stop 326 while face 320 is flush with the front of door frame 304. A door latch mounted in the door engages a door plate mounted in the frame to secure the door in the closed position.

Mobilization belt 100 is secured to the door by opening the door, inserting rolled segment 202 through the space between door edge 322 and door frame 304, and shutting the door such that the door latch engages the door plate. When the door is closed, rolled segment 202 is trapped adjacent rear 321 and door stop 326. Connecting segment 204 is positioned between rear 321 and door stop 326. Connecting segment 204 also extends to be positioned between door edge 322 and door frame 304. The thickness of rolled segment 202 is greater than the space between door 302 and door frame 304 and thus prevents mobilization belt 100 from becoming dislodged from engagement with the door as a patient applies pressure on mobilization belt 100 in direction 330.

Figure 4:
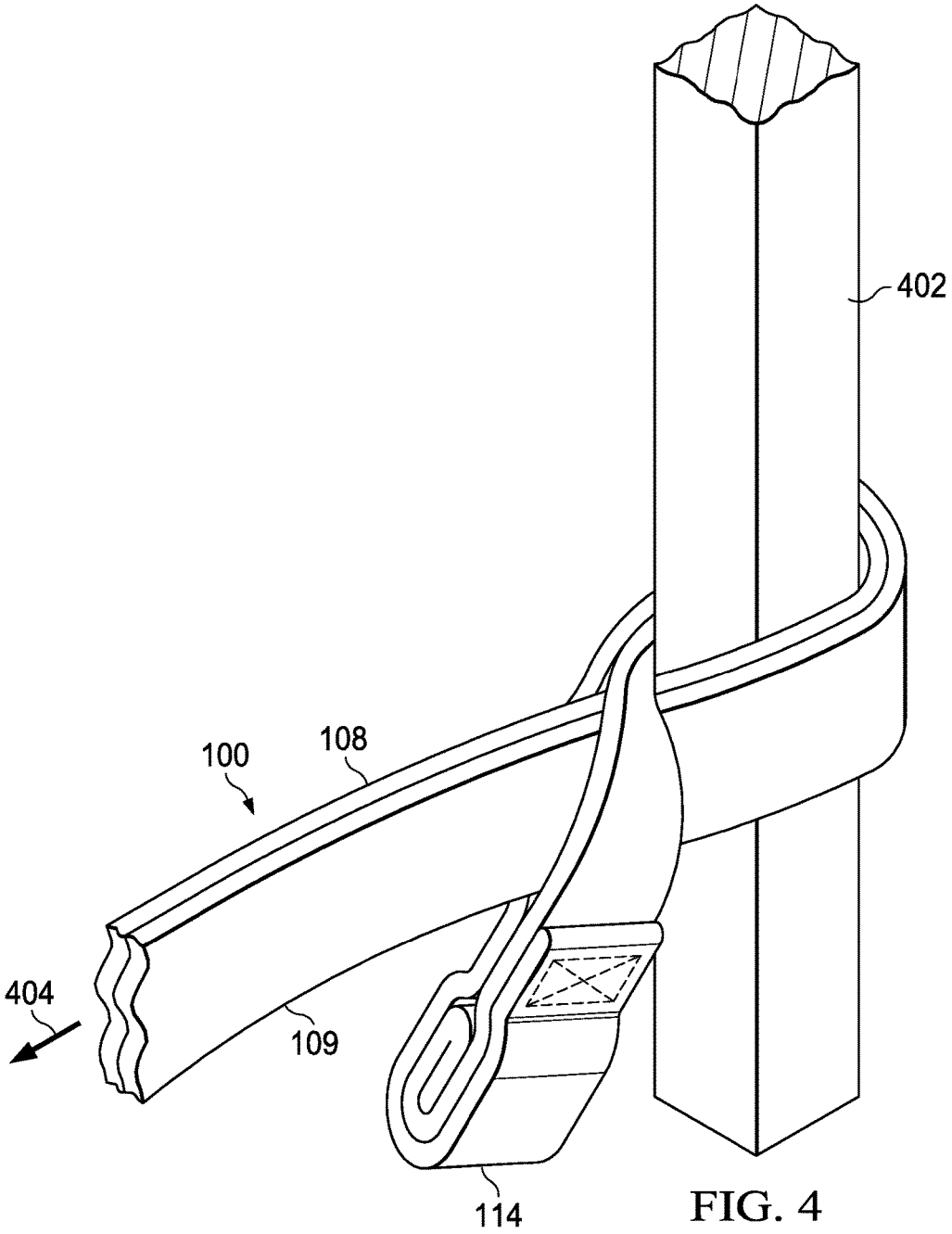
FIG. 4 is an isometric view of a preferred embodiment engaged with a furniture leg.

As shown in FIG. 4, mobilization belt 100 is alternatively secured to a heavy object. The object should weigh approximately the same or more than the patient intending to use the mobilization belt and the object should have a vertical stanchion or handle located generally at height of the affected joint. Band 102 is doubled over such that interior surface 106 of side 108 is adjacent interior surface 106 of side 109. Expanded section 114 is at one end of the doubled over band 102 and cushioned section 116 is at the opposing end. The expanded section end is wrapped half way around vertical stanchion 402. Side 108 is separated from side 109 proximate expanded section 114 enough such that the cushioned section end can pass between sides 108 and 109. The cushioned section end of the doubled over band 102 is pulled through such that any slack between mobilization belt 100 and vertical stanchion 402 is removed. The weight of the object prevents movement of mobilization belt 100 as a patient applies pressure on mobilization belt 100 in direction 404.

Figure 5B:
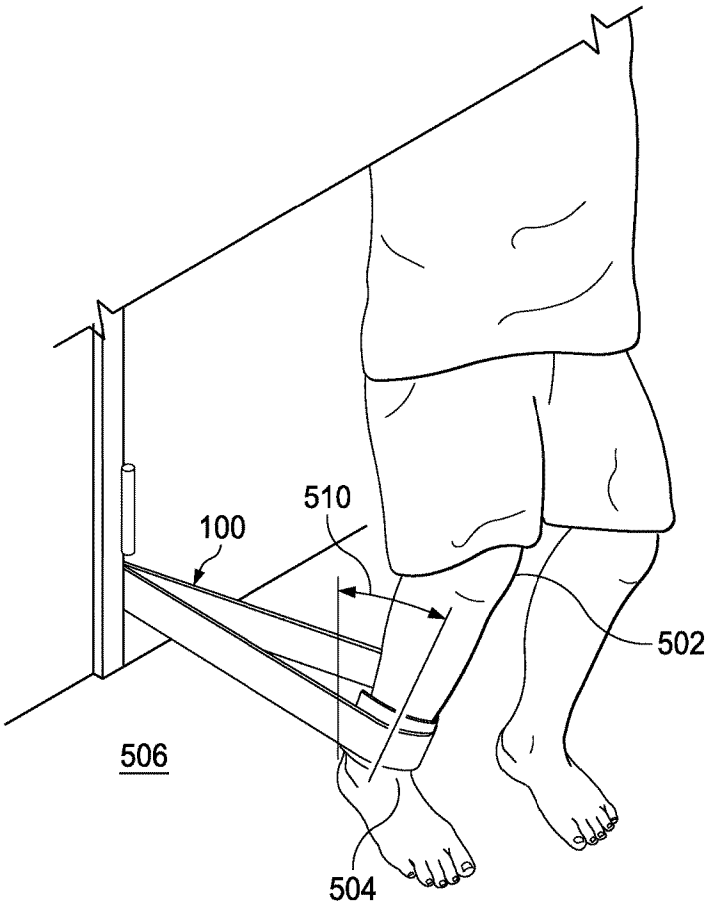
FIG. 5B is an isometric view of a user engaged with a preferred embodiment for joint mobilization of an ankle.
Figure 5A:
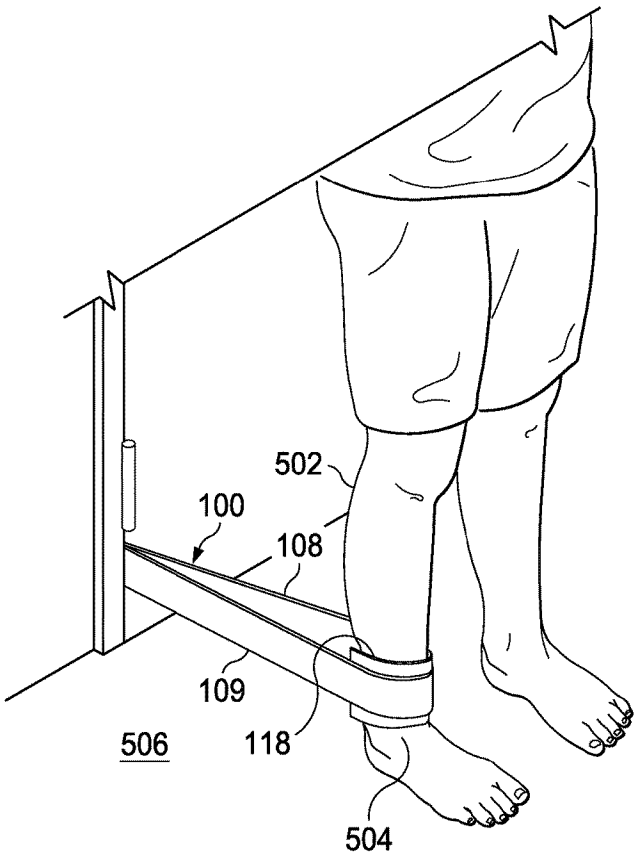
FIG. 5A is an isometric view of a user and a preferred embodiment in a starting position for joint mobilization of an ankle.

Referring to FIGS. 5A and 5B, the preferred steps involved in using the device, for example on a sprained ankle, are shown. FIG. 5A shows the beginning stance of a patient using the mobilization belt to provide joint mobilization exercises on the sprained ankle. Leg 502 of the patient having injured ankle 504 is placed within loop between sides 108 and 109. Pad 118 is positioned in contact with the front of injured ankle 504. The patient assumes a staggered stance to remove any slack in mobilization belt 100 such that mobilization belt 100 is generally parallel with floor 506. Leg 502 is generally straight, perpendicular with floor 506.

As shown in FIG. 5B, the patient then maintains the foot having injured ankle 504 flat on floor 506. The patient bends leg 502 at the knee toward floor 506 through angle 510 to provide resistance at the affected ankle and thus creating joint mobilization of the ankle. Angle 510 generally ranges between 30° and 45°. The knee bend is held for a 10 to 30 second period until straightening leg 502 back to the position shown in FIG. 5A. After a 10 to 30 second rest, the knee bend movement is repeated. The knee bend movement is repeated for approximately three to five times at least four to five days a week.

Figure 6B:
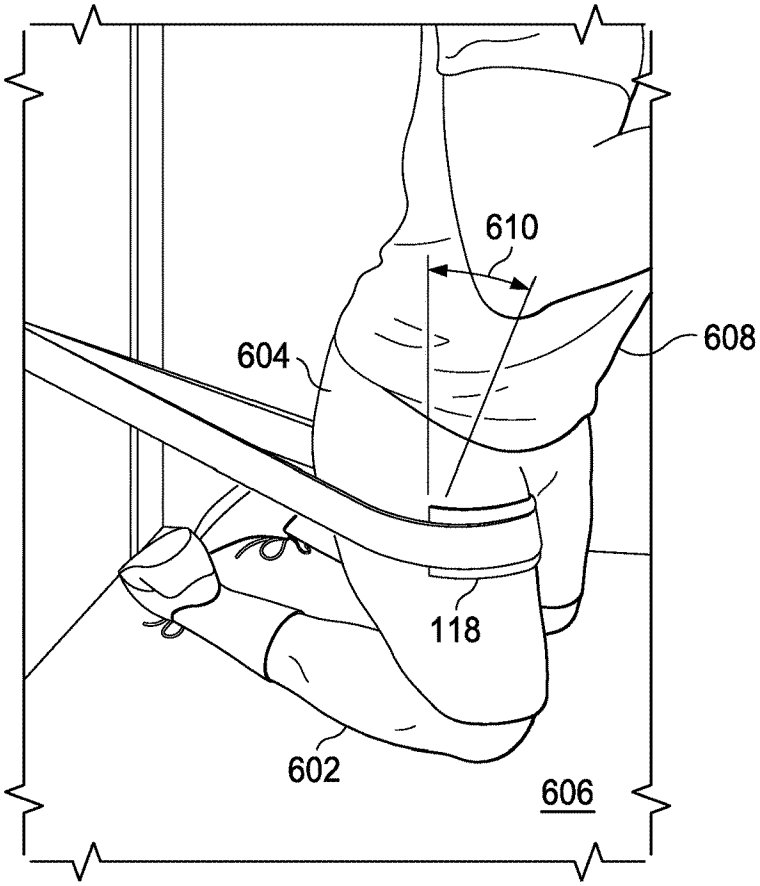
FIG. 6B is an isometric view of a user engaged with a preferred embodiment for joint mobilization of a hip.
Figure 6A:
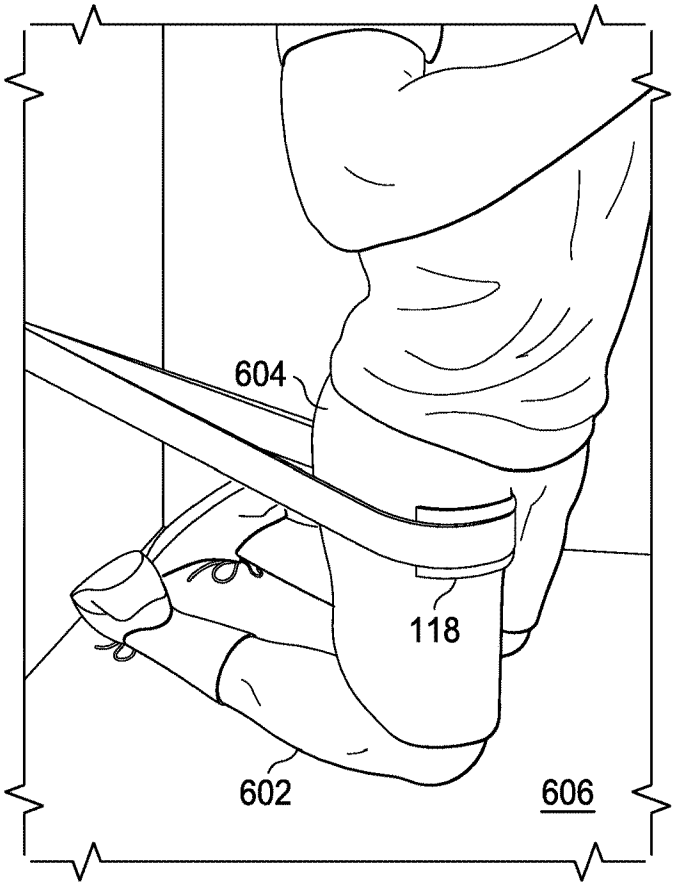
FIG. 6A is an isometric view of a user and a preferred embodiment in a starting position for joint mobilization of a hip.

Referring to FIGS. 6A and 6B, the preferred steps involved in using the device, for example on an injured hip, are shown. FIG. 6A shows the beginning stance of a patient using the mobilization belt to provide joint mobilization exercises on the affected hip. In a kneeling position, leg 602 of the patient having injured hip 604 is placed within loop between sides 108 and 109. Pad 118 is positioned in contact with and as close to the hip crease of injured hip 604 as possible. The patient assumes a staggered stance on the knees with injured hip 604 closest to the rolled segment and removes any slack in mobilization belt 100 such that mobilization belt 100 is generally parallel with floor 606. Leg 602 is generally straight, perpendicular with floor 606.

As shown in FIG. 6B, the patient then maintains the knee associated with injured hip 604 flat on floor 606. The patient leans torso 608, bending at injured hip 604, toward floor 606 through angle 610 to provide resistance at the hip and thus creating joint mobilization of the hip. Angle 610 generally ranges between 10° and 30°. The lean is held for a 10 to 30 second period until straightening torso 608 back to the position shown in FIG. 6A. After a 10 to 30 second rest, the torso lean movement is repeated. The torso lean movement is repeated for approximately three to five times at least four to five days a week.

It is understood that joint mobilization of an ankle and a hip are discussed for demonstration purposes only. Other affected joints in the body can be treated with mobilization belt 100 as well, such as wrist, elbow, shoulder, knee, etc.

Figure 7:
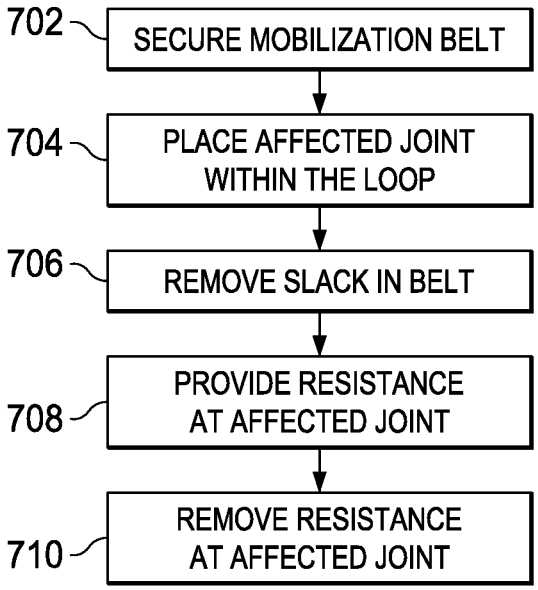
FIG. 7 is flowchart of the steps involved in performing physical therapy on an affected joint with a preferred embodiment.

FIG. 7 is a flowchart representing the steps involved in using mobilization belt 100 for physical therapy of an affected joint. At step 702, mobilization belt 100 is secured. Mobilization belt 100 can be securely positioned in a door jamb as shown in FIGS. 3A and 3B or securely wrapped around a vertical stanchion or handle of a heavy object as shown in FIG. 4. Alternatively, mobilization belt 100 can be held by a physical therapist as well. At step 704, an affected joint is placed within the loop between sides 108 and 109 of mobilization belt 100 such that pad 118 is adjacent the affected joint. At step 706, any slack in mobilization belt 100 is removed. At step 708, the patient provides resistance at the affected joint. In the case of an ankle, the patient bends at the knee toward the ground. In the case of a hip, the patient leans the torso toward the ground, bending at the hip. At step 710, the patient removes resistance at the affected joint. In the case of an ankle, after holding the knee bend for the prescribed duration, the patient straightens the leg with the affected ankle. In the case of a hip, after holding the lean for the prescribed duration, the patient straightens the torso. Steps 708 and 710 may be repeated as often as prescribed by a physical therapist.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A method of performing physical therapy of an affected joint using a vertical stanchion comprising:

providing an inelastic loop having a first side and a second side;

providing a folded end in the inelastic loop;

providing a cushion, attached to the inelastic loop, diametrically opposite the folded end;

securing the inelastic loop to the vertical stanchion;

wherein the step of securing the inelastic loop further comprises:

positioning the first side adjacent the second side;

wrapping the inelastic loop half way around the vertical stanchion;

separating the first side from the second side;

pushing the cushion through the separated first side and second side;

placing the affected joint within the inelastic loop adjacent the cushion;

removing slack in the inelastic loop; and, providing a horizontal resistance to the affected joint by asserting a muscular force against the cushion and the inelastic loop.

* * * * *